US006904725B1

(12) United States Patent
Hansen et al.

(10) Patent No.: US 6,904,725 B1
(45) Date of Patent: Jun. 14, 2005

(54) ROOF WINDOW WITH MAIN FRAME AND SASH COVERING MEMBERS

(75) Inventors: Birgitte Hansen, Copenhagen (DK); Peter Forslund Nielsen, Ishøj (DK); Kaj Nissen, Virum (DK)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 09/647,700

(22) PCT Filed: Mar. 25, 1999

(86) PCT No.: PCT/DK99/00169

§ 371 (c)(1),
(2), (4) Date: Oct. 3, 2000

(87) PCT Pub. No.: WO99/51831

PCT Pub. Date: Oct. 14, 1999

(30) Foreign Application Priority Data

Apr. 7, 1998 (DK) ..... 0495/98

(51) Int. Cl.[7] ..... E04B 7/18

(52) U.S. Cl. ..... 52/200; 52/72; 49/153; 49/192; 49/390

(58) Field of Search ..... 52/72, 200, 204.53, 52/204.54, 211; 49/463–465, 495, 153, 253, 49/192

(56) References Cited

U.S. PATENT DOCUMENTS 4,480,406 A * 11/1984 Frank ..... 49/153
4,486,978 A * 12/1984 Frank ..... 49/153
4,986,039 A * 1/1991 Weisner ..... 52/72
5,271,124 A 12/1993 Sandell
5,568,702 A * 10/1996 Frank et al. ..... 49/153
5,581,942 A * 12/1996 Sill et al. ..... 49/253

FOREIGN PATENT DOCUMENTS

| | | |
|---|---|---|
| DE | 24 43 098 | 3/1975 |
| DE | 25 03 519 | 8/1976 |
| GB | 2 045 844 A | 11/1980 |
| SE | 209 531 | 12/1966 |
| SE | 374 578 | 3/1975 |

* cited by examiner

*Primary Examiner*—Carl D. Friedman
*Assistant Examiner*—Yvonne M. Horton
(74) *Attorney, Agent, or Firm*—Merek, Blackmon & Voorhees, LLC

(57) ABSTRACT

In a roof window with a frame structure and an openable, pane supporting sash structure, the top, bottom and side members (1–8) of the frame and sash structures are for the major part made as wood profiles, which on the outwards facing sides are covered by covering members of weather-shielding material connected with the wood profiles by means of engagement and securing means. The covering members (11, 12, 15, 17, 20, 21, 32) serve as sealing enclosure for the subjacent wood profiles in the frame and sash structures on all surfaces on the outside of the roofing, and engagement and securing means (23–29, 40) are designed in such manner and/or positioned such relative to the covering members that water and moisture penetration into the wood profiles is substantially prevented.

14 Claims, 4 Drawing Sheets

ROOF WINDOW WITH MAIN FRAME AND SASH COVERING MEMBERS

Figure 1:
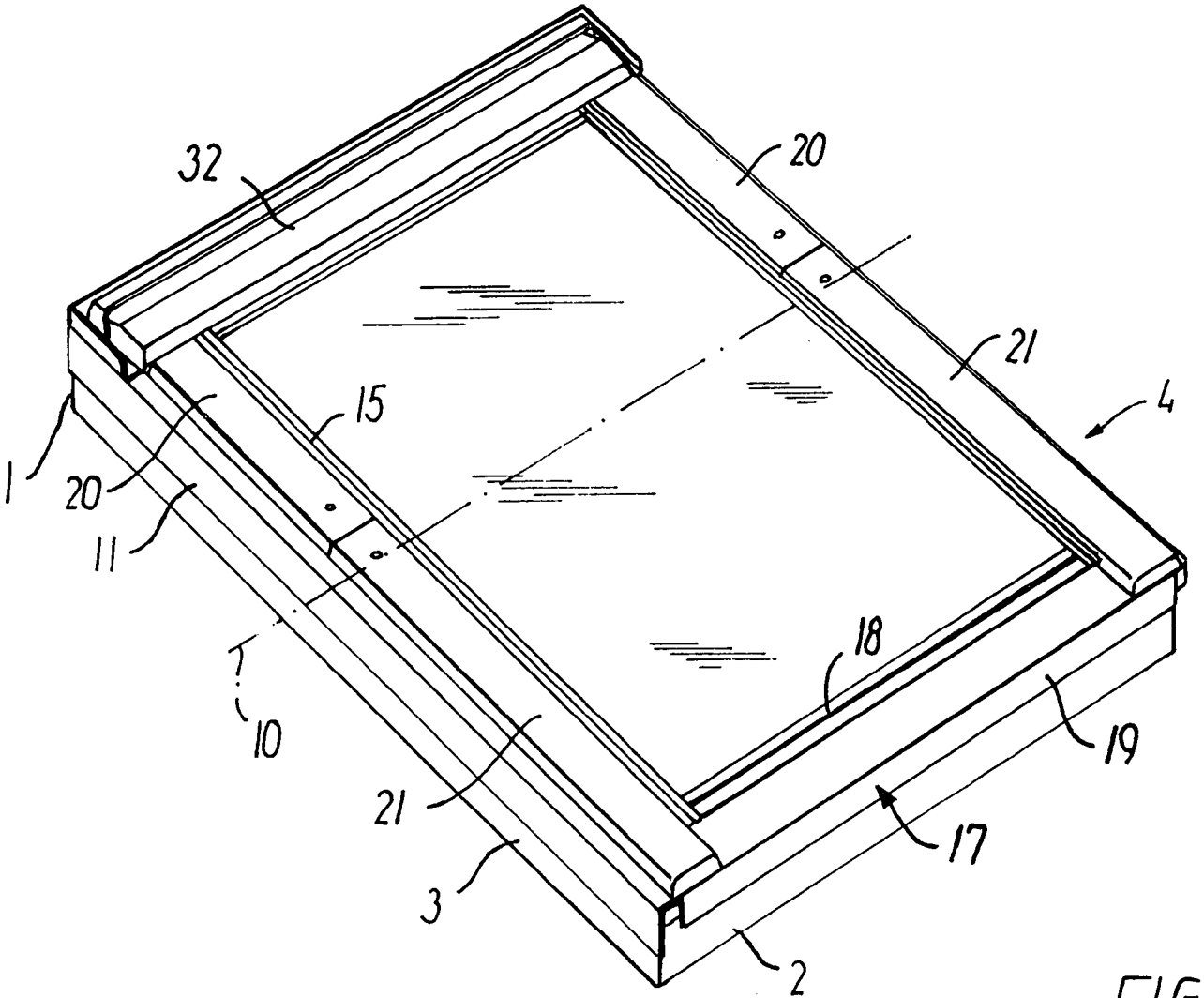

The present invention relates to a roof window with a pane supporting frame structure consisting of horizontal top and bottom members connected by parallel side members, which are at least partially wood profiles which on the outwards facing sides are covered by weather-shielding covering members for sealing enclosure of the subjacent wood profiles on all surfaces protruding from the roofing, said covering members being connected with the wood profiles by means of engagement and securing means which are designed in such manner and/or positioned such relative to the covering members that penetration of water and moisture into the wood profiles is substantially prevented, the covering members comprising a hood-like upper covering cap for covering the top member, an interior glazing profile for covering a part of the upper edge of each frame side member facing the light-admitting area of the window, an exterior covering member for covering the part of the exterior side of each frame side member protruding from the roofing and the adjoining part of the upper edge of the frame side member, and a cap member overlapping the glazing profile and said covering member, the cap member being at the bottom secured to the lower part of the side member, whereas at the top it is secured to the upper part of the side member.

Roof windows of this type, both openable and not openable, are well known and are widely used for ensuring improved admittance of daylight when converting ceilings of buildings into rooms for accommodation and business purposes.

The purpose of using weather-shielding covering members, which may consist of comparatively thin metal sheet profiles, for instance of aluminium, or plastic profiles, is to provide, to the highest degree possible, a total exterior protection of the wood profiles in the top, bottom and side members of the main frame and sash structures.

In conventional embodiments of roof windows the covering members are typically secured to the wood profile members of the main frame and sash structures by means of screw connections which are screwed directly into the subjacent wooden parts, which in order to obtain a sufficiently exact mounting requires pre-bored screw holes in the wooden parts and has turned out to entail a risk of moisture or water penetration into the wooden parts, in particular through the screw holes in the covering members.

In openable roof windows, the covering members on the outwards facing sides of the side members of the main frame and sash structures typically comprise an upper and a lower cap member in connection with the upper part of the main frame side member above the pivot axis and with the lower part of the sash side member under the pivot axis such that the lower cap member may follow the swinging of the sash structure by opening of the window. In conventional windows it has in respect of these cap members turned out to be difficult to obtain a satisfactory sealing at the transition between the upper and lower cap members, and at the lower end of the lower cap members.

Attempts have been made to solve this problem by use of a roof window known from DE-A-24 43 098, in which covering members are secured to the main frame and sash profiles by engagement with shackles fastened to the profiles by screws or nails. However, this design makes it necessary to mount the covering members by sliding them on the main frame and sash profiles in the longitudinal direction thereof.

The object of the invention is to provide a system of covering members for a roof window with a fully closed enclosure of the wooden parts of the frame and sash profiles, the mounting being at the same time facilitated.

To meet this object, the roof window according to the invention is characterized in that the cap member is retained at its upper end at said top by said upper covering cap and is provided at said bottom with an integral bent, hidden engagement means for snapping engagement with an engagement means secured at the lower end of the side member.

In this way a particular good protection of the wood profiles against moisture or water penetration is obtained and the mounting is at the same time facilitated, the cap member being first slid under the upper covering cap and then connected with its lower end to the lower end of the side member by snapping engagement.

The invention may advantageously be used both in connection with not openable roof windows with a frame structure fixedly positioned in the roof structure and in connection with conventional, openable roof windows.

A preferred embodiment of such an openable roof window is according to the invention obtained thereby that the sash structure has a pivot axis parallel with and approximately halfway between the top and bottom members, and that said cap member comprises an upper and a lower cap member placed on either side of the pivot axis, the upper cap member being secured to the upper part of the main frame side member or to an intermediate sash arm connected between the frame and sash side members, whereas the lower cap member is secured to the lower part of the sash side member, said cap members being at a short distance from the lower end of the upper cap member and the upper end of the lower cap member provided with securing means for being secured to fittings in fixed connection with the main frame side members or said intermediate sash arms, respectively, and with the sash side members, but positioned outside of the wood profiles thereof.

Further advantageous embodiments of the roof window according to the invention and the accompanying covering members are stated in the subclaims.

Figures 2, 3:
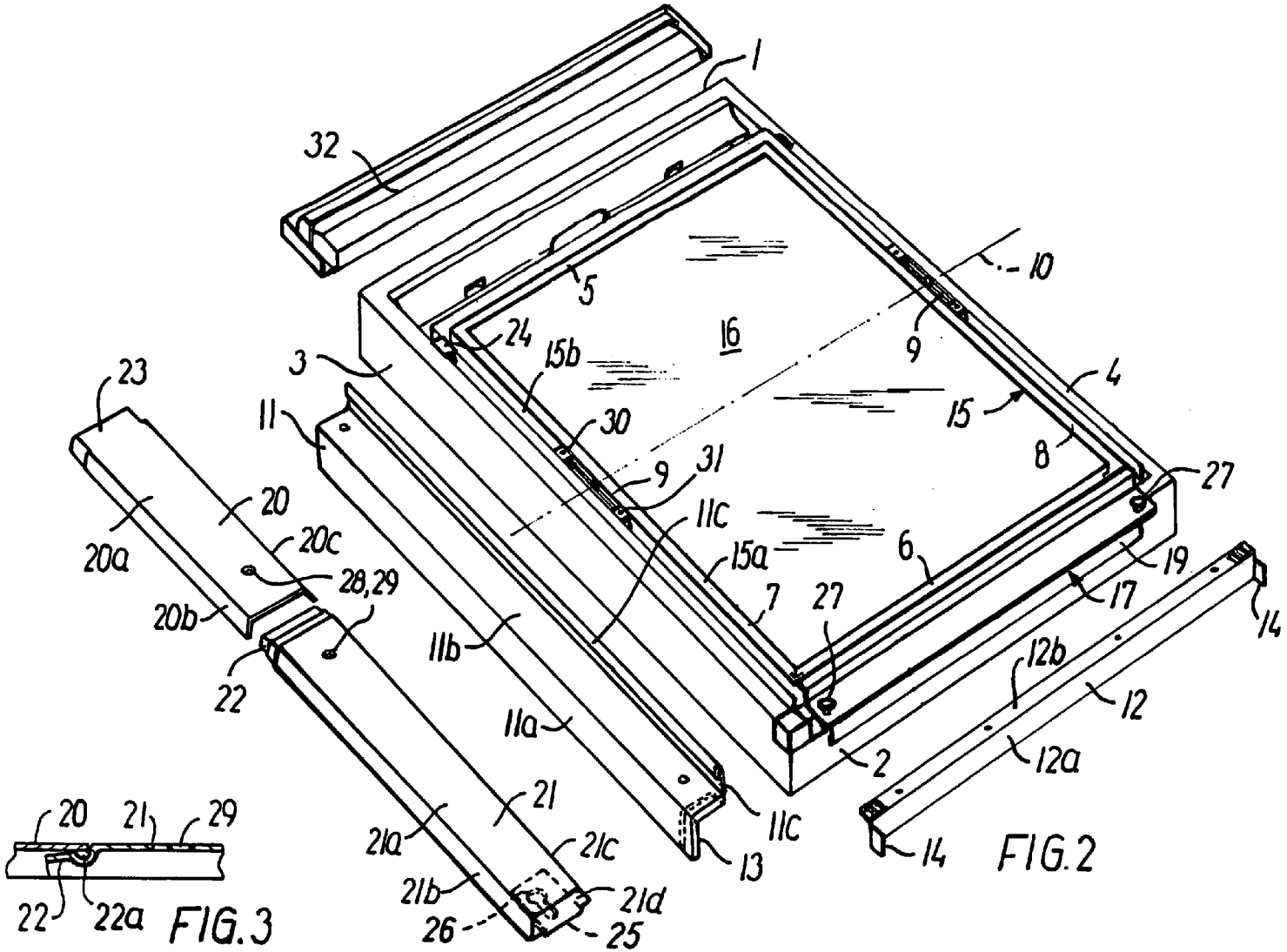
Figure 4:
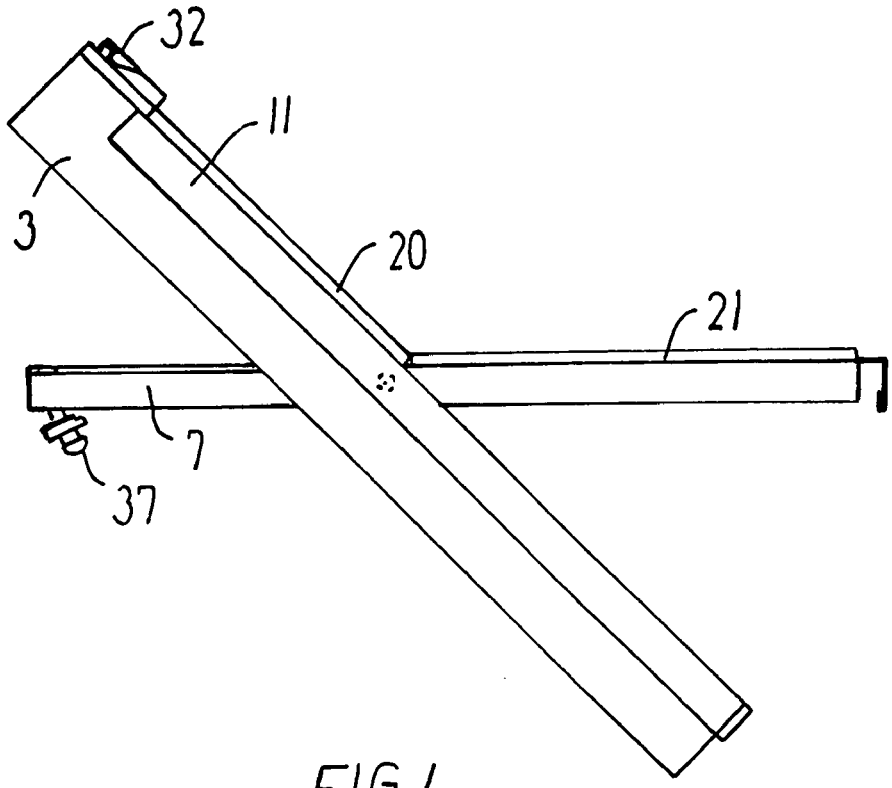
Figure 5:
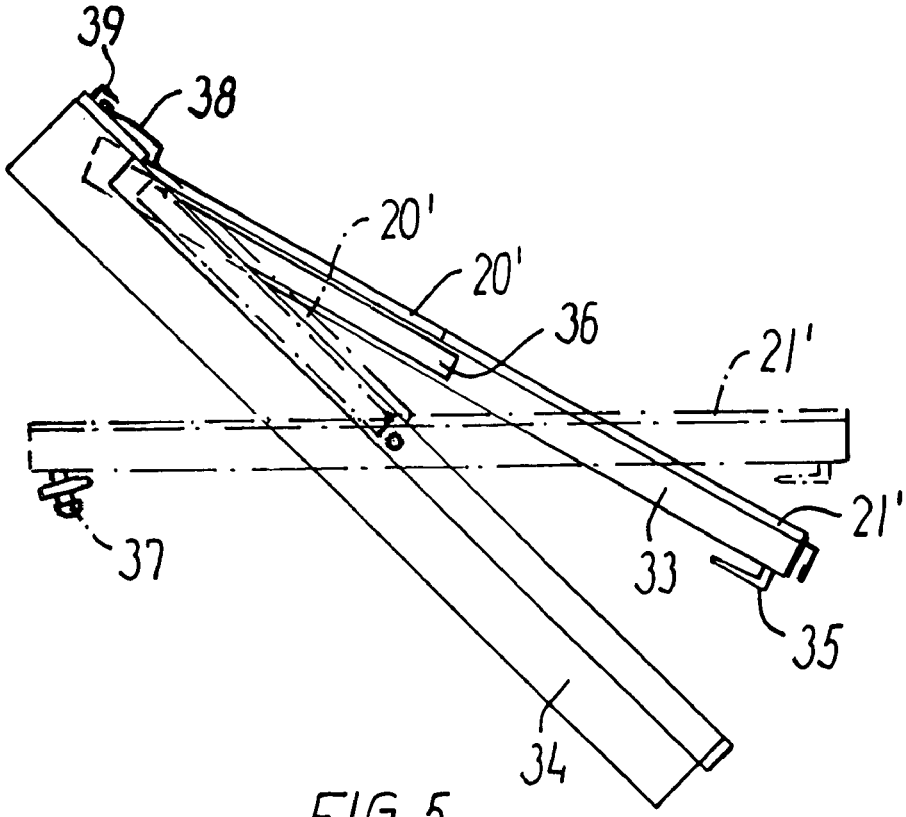
Figure 6:
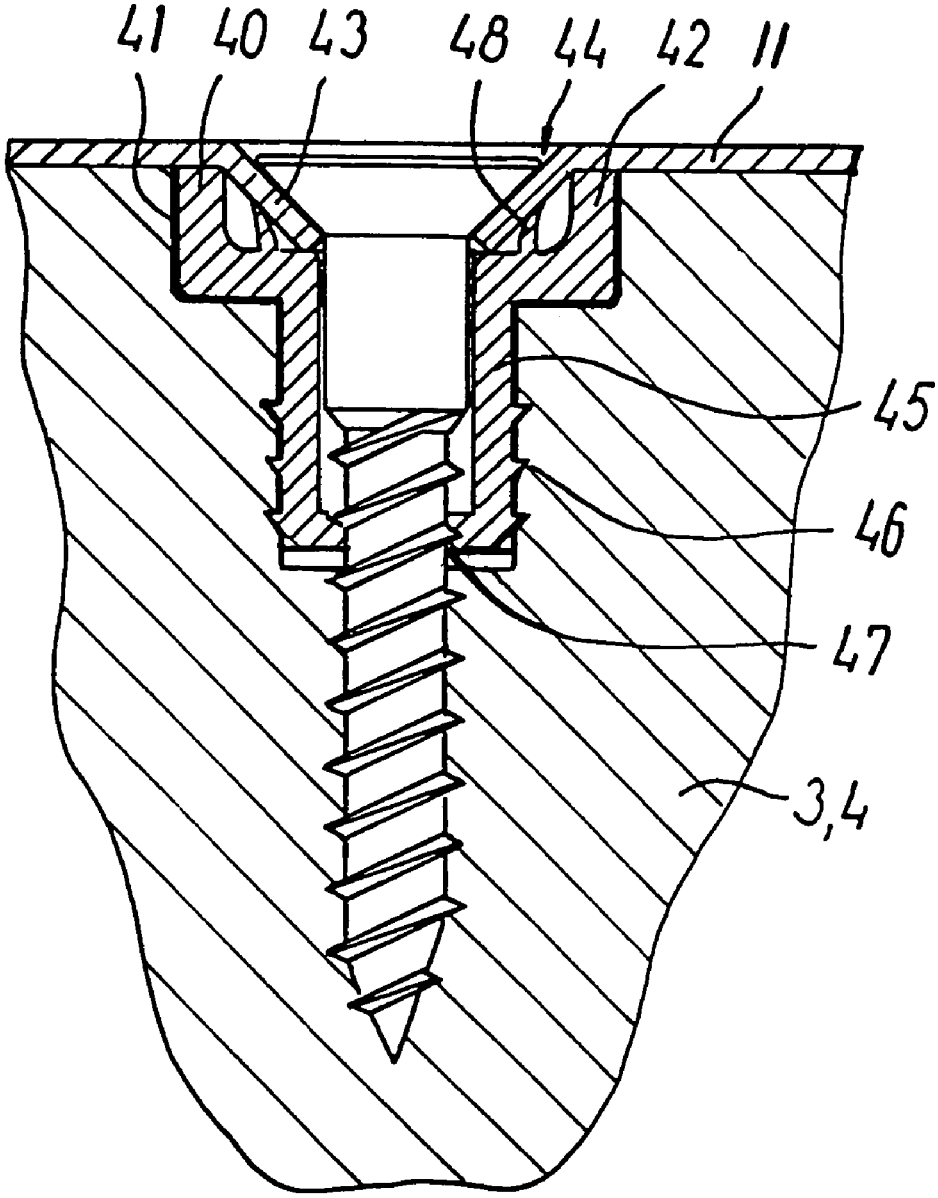

The invention will now be explained in detail in the following with reference to the schematic drawing, in which FIG. 1 is a perspective view of an embodiment of a roof window according to the invention, FIG. 2 is an exploded view corresponding to FIG. 1, in which the covering members have been removed from the wood profiles in the frame and sash structures of window, FIG. 3 is a schematic lateral view, partly in section, for illustration of an example of the connection between an upper and a lower cap member, FIG. 4 is a lateral view, partly in section, of the window shown in FIGS. 1 and 2 in an open position, FIG. 5 is a lateral view of a particular embodiment of the roof window as a combined top/pivot window, and FIG. 6 is a partial section of a frame side member for illustrating the fastening of frame covering members.

In the embodiment shown in FIGS. 1 and 2, the roof window according to the invention is an openable window with a main frame structure comprising a top member 1, a bottom member 2, and side members 3 and 4, and an openable sash structure with a top member 5, a bottom member 6, and side members 7 and 8.

By means of swing fittings 9, known per se, between the frame and sash side members 3, 4 and 7, 8 the sash structure is pivotally journalled in the frame structure with an axis of rotation 10 parallel with the top and bottom members and substantially halfway between them.

The top, bottom and side members of the frame and sash structures are for the major part built up by wood profiles which on all surfaces that are exposed to the weather are covered by covering members which, in the embodiment shown, are constituted of comparatively thin metal sheet profiles, for instance of aluminium, and which together provide a completely weather-shielding enclosure of the window.

Thus, the frame side members 3 and 4 are covered by elongate covering members 11, with a substantially Z-shaped cross section comprising a sidewall 11*a* covering an upper part of the outwards facing side surface of the frame side member positioned outside the roofing perpendicular to the roof surface, in which the window is mounted, an upper wall 11*b* covering the adjacent upper edge of the frame side member, and a comparatively low flange wall 11*c* protruding from the upper wall.

The frame bottom member 2 is covered by an elongate covering member 12 with substantially L-shaped cross section and comprising a bottom wall 12*a* covering the underside of the frame bottom member perpendicular to the roof surface, and an upper wall 12*b* covering the adjacent upper side of the frame bottom member.

To establish a tight connection at the transition between the two frame side covering members 11 and the frame bottom covering member 12, the side covering members 11 are at their lowest ends provided with engagement flanges 13 in form of bent exterior parts of the sidewalls 11*a* for engagement with protruding flange members 14 from the ends of the bottom covering member 12.

The frame covering members 11 and 12 are connected with their respective frame profiles 3, 4 and 2 by means of screws which are preferably screwed into the upper edges of the frame profiles, as explained in detail in the following with reference to FIG. 5.

In the sash structure the top and side members are covered by an interior glazing profile 15 facing the pane area of the window and having an inwards protruding glazing profile 15*a* which via an intermediate sealing strip abuts the edge of the pane member 16 of the window, said pane member being typically a 2 or 3 layer sealed glazing unit. In continuation of the glazing profile flange 15*a*, the glazing profile 15 comprises along the edges of the double pane 16 a substantially U-shaped profile member with an upright flange wall 15*b*, which on the sash side members 7 and 8 follows the low flange wall 11*c* of the covering members 11 on the frame side members 3 and 4.

Correspondingly, the sash bottom member 6 is covered by a substantially L-shaped covering member 17 with a glazing profile 18 here covering the entire upper side of the sash bottom member 6, and by an underlying wall 19 covering the underside of the sash bottom member and overlapping the covering member 12 on the frame bottom member 2.

The parts of the covering members 11 and the glazing profiles 15 positioned on the top side of the frame and sash side members are on each side overlapped by the axis of rotation 10 of an upper cap member 20 and a lower cap member 21, respectively. These cap members are designed as flat, trough-shaped profiles with identical, substantially U-shaped profile cross section comprising an exterior wall 20*a*, 21*a* and two low side walls 20*b*, 21*b* and 20*c*, 21*c* covering the low upright flange walls 11*c* and 15*b* on the covering member 11 and the glazing profile 15, respectively.

As will be seen from FIGS. 2 and 3, the lower cap member 21 is at its upper end provided with a joggled connection member 22 which is inserted under the lower end of the upper cap member 20. The connection member 22 has such a shape, for instance slightly wedge-shaped as shown, that the cap members 20 and 21 in the closed position of the window are positioned in extension of one another, their exterior walls 20*a* and 21*a* and sidewalls 20*b*, 21*b* and 20*c*, 21*c*, respectively, in alignment. This design of the cap members 20 and 21 imparts to the window in the closed position an outer appearance of the window which is attractive from a design point of view, the cap members 20 and 21 appearing at each side of the window as one integral member.

At the same time the joggling of the connection member 22 ensures that the lower cap member 21 secured to the sash side member 7, 8 by opening of the window as shown in FIG. 3 may follow the lower part of the sash structure during its swinging out and thus unimpededly may swing outwards relative to the upper cap member 20, which in the embodiment shown is secured to the frame side member 3, 4.

As will be more clearly seen from FIG. 3, the joggled connection member 22 forms at the transition to the cap member 21 a groove 22*a* providing a pressure relief chamber which prevents water from penetrating from below under the upper cap member 20.

In the embodiment shown, the lower cap member 21 is manufactured by a pressing operation such that the side carriages 21*b*–*c* at the bottom are shaped in one piece with a bottom wall 21*d* with smooth corners. This kind of closing contributes to the attractive appearance of the window and provides a good protection of the lower parts of the sash side members 7 and 8 against the weather.

The upper and lower cap members 20 and 21 are according to the invention connected with the respective frame and sash side members 3, 4 and 7, 8, respectively, such that they are easy to mount with great accuracy and moreover easy to dismount, the moisture influence on and water penetration into the wooden parts of the frame and sash side members being substantially prevented.

The upper cap member 20 is thus secured by a connection member 23 at its upper end solely by an upper covering member 32 for the frame and sash top members 1 and 5 against a support member 24, which in the embodiment shown is secured to the top side of the frame side member 3, 4.

The lower cap member 21 is at its lowest end provided with an engagement means which in the embodiment shown has the shape of an engagement bracket protruding from the bottom wall 21*d* and being parallel with the exterior wall 20*a*, said bracket having a keyhole-shaped recess 26 for engagement with and retainment of a tap member 27 secured to the covering member 17 on the sash bottom member 6.

At their opposite ends the upper cap member 20 and the lower cap member 21 are provided with securing means in the form of screw holes 28 for screws 29 to be screwed into screw fittings 30 and 31, which in the embodiment shown are connected with the frame and sash side members 3, 4 and 7, 8 outside the wood profiles thereof.

The screw fittings 30 and 31 may advantageously be made of plastic material and secured to those parts of the swing fitting 9 which is connected with the frame side member 3, 4 and the sash side member 7, 8, respectively. In this way it is not necessary to drive fastening screws into the wooden parts of the frame and sash side members.

At the top members 1 and 5 of the frame and sash structures the enclosure of the window is finished by the substantially hood-shaped top cap 32, which in the embodiment in FIGS. 1–3 is made in one piece and connected with the frame top member 1. The top cap 32 is designed such that it covers the upper parts of the covering members on the frame and sash side members 3, 4, and 7, 8, respectively, including the upper parts of the upper cap members 20.

In FIG. 5 in a schematic side view an alternative embodiment of the roof window as a combined turn/pivot window is shown, in which the sash structure under normal use is top-hung relative to the frame structure 34, such that the window, as shown in a solid line, functions as a top-hung pivot window which is opened by means of a separate control handle 35 on the interior side of the sash bottom member.

To make it possible to swing the window sash approximately 180° to a convenient cleaning position, the sash structure 33 is moreover pivotally connected with an intermediate sash with sash arms 36, which in the closed position of the window are positioned between the upper parts of the frame and sash side members 2, 4 and 7, 8, respectively, and which during normal use of the window as a top-hung turning window follow the sash side members. The axis of rotation of this swingable connection lies approximately halfway between the top and bottom members in the same manner as shown in FIG. 4, and operation of the window to this pivot or swing movement is carried out in a manner frequently used in connection with roof windows by means of a ventilation and control flap 37 which releases a (not shown) locking mechanism positioned between the frame and sash top members.

As this double pattern of movement entails that the upper part of the sash both during normal use as a top-hung window must be pivotable outwards relative to the frame and, at said swing movement to a cleaning position, has to be swingable inwardly relative to the frame in the same manner as shown in FIG. 4, the upper cap member 20' which besides may be designed in the same manner as the cap member 20 in FIGS. 1 and 2, being at each side secured to the intermediate sash arm 36, the upper end of a bottom part 38 of the top cap connected with the intermediate sash being retained against a support member connected with the intermediate sash arm, whereas the lower part with a screw connection is secured to the screw fitting 30' which is connected with the part of the (not shown) swing fitting connected with the intermediate sash arm 36 between the intermediate sash arm and the sash side member 7, 8.

In the embodiment shown in FIG. 5, the top cap is also in consideration of the above moving possibilities made in two pieces, comprising the bottom part 38 connected with the intermediate sash and a top part 39 connected with the frame top member 39.

The above design and mounting of the upper and lower cap members 20 and 21 provide a particular good protection of the wooden parts of the sash profiles and the other wooden parts of the frame profiles not covered by the other covering members, i.a. as a consequence of the fact that fastening screws for the caps are not screwed into the wooden parts.

As shown in FIG. 6 a good protection may be obtained in respect of the screw connections between the frame side covering members 11 and the frame side members 3, 4 against water penetration into the wooden parts of the frame side members by use of a bearing bushing 40 of plastic material to be placed in a pre-bored groove 41 in the wood profile. The bearing bushing 40 has a gradually reduced cylindrical shape with a head portion 42 for receiving the bent down (by countersinking) edge area 43 of the covering member 11 around the screw hole 44 and a constricted shaft member 45 with protruding barbs 46 for retaining the bushing in the pre-bored recess 41. A hole 47 is provided in the bottom of the shaft part 47 with a smaller diameter than the fastening screw, such that when the screw is driven in, a good sealing is provided.

For further safeguarding of the screw connection an upright collar 48 may be provided in the bottom of the head portion 42 of the bushing or several upright flaps serving as washer plate against the countersunk edge area 43 ensuring that the screw head cannot be screwed over and deform the covering member 11.

What is claimed is:

1. A roof window with a pane supporting sash structure composed of horizontal top and bottom members (1, 2; 5, 6) connected by parallel side members (3, 4; 7, 8), said side members comprising at least partially wood profiles and weather-shielding covering members (11, 12, 15, 17, 20, 21, 32) covering the outwards facing sides of said wood profiles for sealing enclosure of the wood profiles on all surfaces protruding from the roofing, engagement and securing means (23–29, 40) for connection of said covering members with the wood profiles, said engagement and securing means being designed or positioned to substantially prevent penetration of water and moisture into the wood profiles, the weather shielding covering members comprising an upper covering cap (32) for covering the top member (1, 5), an interior glazing profile (15) for covering a part of an upper edge of each sash side member facing the light admitting area, an exterior covering member (11) for covering a part of an exterior side of each frame side member (3, 4) protruding from the roofing and an adjoining part of the upper edge of a frame side member, and a cap structure (20, 21) extending between said top and bottom members and overlapping the glazing profile (15) and said covering member (11), said cap structure having a top end at said top member and a bottom end at said bottom member characterized in that the top end of the cap structure (20, 21) is dismountably retained solely by said upper covering cap (32), the cap structure being integrally formed at its bottom end with a bent, hidden engagement means (25, 26) for snapping engagement with an engagement means (27) secured at said lower end of the parallel side member (7, 8).

2. A roof window according to claim 1, characterized in that the frame structure comprises a pivot sash accommodated in a main frame structure with top, bottom and side members (1–4) at least partially made of wood profiles, the upper covering cap (32) covering the top members (1, 5) of the main frame and sash structures, whereas the exterior covering member (11) covers the exterior side of each main frame side member (3, 4) and the adjoining part of its upper edge.

3. A roof window according to claim 2, characterized in that the sash structure has a pivot axis (10) parallel with and approximately halfway between the top and bottom members (1, 2; 5, 6), and that said cap structure comprises an upper cap member (20) and a lower cap member (21) placed on either side of the pivot axis, the upper cap member (20) being secured, at a short distance from a lower end thereof, to the upper part of the main frame side member (3, 4) or to an intermediate sash arm (36) connected between the main frame and sash side members (3, 4; 7, 8), whereas the lower cap member (21), at a short distance from an upper end thereof, is secured to the lower part of the sash side member, the cap members (20, 21) being provided with securing means for being secured to fittings in fixed connection with the frame side member (3, 4) or said intermediate sash arm, respectively, and with the sash side member (7, 8) outside the wood profiles thereof.

4. A roof window according to claim 1, characterized in that the engagement means at the bottom end of the cap structure (21) comprises an engagement bracket (25) parallel with the exterior wall (21*a*) of the cap member, said bracket being provided with a keyhole-shaped recess (26) for engagement with and securing of a pin member (27) fastened to said side member (7, 8).

5. A roof window according to claim 3, characterized in that said securing means comprise screw holes (28) in the exterior walls (20*a*, 21*a*) of the cap members (20, 21) and in that said fittings are screw fittings (30, 31) for screws (29).

6. A roof window according to claim 5, characterized in that said screw fittings (30, 31) are connected with a swing fitting in connection with the main frame side member (3, 4) or said intermediate sash arm (36) and the sash side member (7, 8), respectively.

7. A roof window according to claim 1, characterized in that the cap structure comprises at least one cap member (20, 21) designed as a flat, trough-shaped profile with U-shaped profile cross section comprising an exterior wall (20*a*, 21*a*) and two low side walls (20*b–c*, 21*b–c*) covering upright flange walls (15*b*, 11*c*) on the glazing profile (15) and the exterior covering member (11).

8. A roof window according to claim 3, characterized in that the upper and the lower cap members have the same profile cross section and that the lower cap member (21) at its upper end has a joggled connection member (22) inserted under the lower end of the upper cap member (20), said connection member having such a shape that the cap members (20, 21) in the closed position of the window are placed with their exterior walls (20*a*, 21*a*) and side walls (20*b–c*, 21*b–c*) in alignment with each other, and in that the lower cap member (21), when the window is opened, may swing unimpededly outwards relative to the upper cap.

9. A roof window according to claim 8, characterized in that said joggled connection member (22) on the lower cap member (21) against the lower end of the upper cap member (20) forms a pressure relief chamber (22*a*) to prevent water penetration from below under the upper cap member (20).

10. A roof window according to claim 7, characterized in that the lower cap member (21) at its bottom end is provided with a bottom wall (21*d*) integrally connected with its side walls (21*b–c*).

11. A roof window according to claim 4, characterized in that said engagement bracket (25) is designed as a bent flange member in parallel with the exterior wall (21*a*) of the lower cap member (21), said flange member being connected with said bottom wall (21*d*).

12. A roof window according to claim 1, characterized in that each exterior frame covering member (11) at its lowest end is provided with an engagement flange (13) for sealing, positive locking engagement with a protruding flange member (14) from either end of an exterior frame covering member (12) for the frame bottom member (2).

13. A roof window according to claim 3, in which the sash structure (33) under normal use is accommodated as a top-hung pivot window with an axis of rotation at the main frame and sash top members (1', 5'), whereas said pivot axis approximately halfway between the top and bottom members (1', 2'; 5', 6') is provided by pivotal connection of the sash side members (7', 8') to intermediate sash arms (36) with a view to making a turning of the window into a cleaning position possible, characterized in that the upper cap member (20') is secured to said intermediate sash arms (36), and that an upper covering member for the top members (1', 5') is made in two pieces with a lower part (38) connected with the intermediate sash and an upper part (39) connected with the frame top member (1').

14. A roof window according to claim 1, characterized in that frame covering members (11) are secured to the frame structure (3, 4) by screw connections (29) screwed into bearing bushings (40) of plastic material, said bushings being secured to the wood profiles of the frame structure (3, 4).

* * * * *